US011845125B2

(12) United States Patent
Seo

(10) Patent No.: US 11,845,125 B2
(45) Date of Patent: Dec. 19, 2023

(54) METHOD FOR MANUFACTURING CAST IRON CASTING WITH FINING GRAPHITE AND SUSPENSION PART

(71) Applicants: HYUNDAI MOTOR COMPANY, Seoul (KR); Kia Corporation, Seoul (KR)

(72) Inventor: Dong-Lim Seo, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/846,117

(22) Filed: Jun. 22, 2022

(65) Prior Publication Data

US 2022/0324013 A1 Oct. 13, 2022

Related U.S. Application Data

(62) Division of application No. 16/684,982, filed on Nov. 15, 2019, now Pat. No. 11,396,041.

(30) Foreign Application Priority Data

Dec. 27, 2018 (KR) ..... 10-2018-0170931

(51) Int. Cl.
*B22D 3/00* (2006.01)
*C21D 5/00* (2006.01)

(52) U.S. Cl.
CPC ..... *B22D 3/00* (2013.01); *C21D 5/00* (2013.01)

(58) Field of Classification Search
CPC .. C21D 5/00; C21C 1/10; C22C 37/04; C22C 33/08; B62D 7/18
See application file for complete search history.

(56) References Cited

U.S. PATENT DOCUMENTS 3,971,433 A 7/1976 Duchenne
6,126,713 A 10/2000 Igarashi et al.
(Continued)

FOREIGN PATENT DOCUMENTS

CN 102367537 B * 9/2013
CN 105886888 A 8/2016
(Continued)

OTHER PUBLICATIONS

A. Javaid, C. Labrecque, M. Gagne, Structure and Property Control in Thin-Wall Ductile Iron Castings by Optimizing the Molten Metal Processing, LMPC 2011 (Year: 2011).*

*Primary Examiner* — Anthony M Liang
*Assistant Examiner* — Jacob J Gusewelle
(74) *Attorney, Agent, or Firm* — Fox Rothschild LLP

(57) ABSTRACT

A method for manufacturing an austempered ductile cast iron and a product made from the austempered ductile cast iron manufactured by the method are disclosed. In the method for manufacturing an austempered ductile cast iron, spheroidizing agent and primary inoculant are added to a raw molten metal to create homogeneous spheroidal graphite creation in a deep part of a matrix and the raw molten metal to which the spheroidizing agent and the primary inoculant are added is injected into a mold to which secondary inoculant is locally applied, to micronize spheroidal graphite of a local structure coated with the secondary inoculant into fine graphite that is easy to machine, thereby enhancing workability as compared with a conventional austempered ductile cast iron.

3 Claims, 9 Drawing Sheets

(56) References Cited

U.S. PATENT DOCUMENTS

| | | | | |
|---|---|---|---|---|
| 6,258,180 | B1 * | 7/2001 | Wilde | C21D 5/00 148/612 |
| 10,612,105 | B2 | 4/2020 | Liptak | |
| 10,767,238 | B2 | 9/2020 | Liptak | |
| 2017/0298481 | A1 | 10/2017 | Liptak | |
| 2018/0305796 | A1 | 10/2018 | Liptak | |
| 2019/0127813 | A1 | 5/2019 | Liptak | |

FOREIGN PATENT DOCUMENTS

| | | | |
|---|---|---|---|
| CN | 107058861 | A | 8/2017 |
| JP | 2-080505 | A | 3/1990 |
| JP | 2-118019 | A | 5/1990 |
| JP | 8-209216 | A | 8/1996 |
| JP | 8-209217 | A | 8/1996 |
| JP | 10-273710 | A | 10/1998 |
| JP | 10-317039 | A | 12/1998 |
| JP | 2000-239780 | A | 9/2000 |
| JP | 2002-317238 | A | 10/2002 |
| JP | 2012-162766 | A | 8/2012 |
| KR | 10-1193719 81 | | 10/2012 |
| KR | 10-2018-0132857 | A | 12/2018 |

* cited by examiner

METHOD FOR MANUFACTURING CAST IRON CASTING WITH FINING GRAPHITE AND SUSPENSION PART

CROSS-REFERENCE TO RELATED APPLICATION

This application is a divisional of application Ser. No. 16/684,982, filed Nov. 15, 2019, which claims priority to Korean Application No. 10-2018-0170931, filed Dec. 27, 2018. The disclosures of which are incorporated herein by reference in their entirety.

BACKGROUND OF THE DISCLOSURE

Field of the Disclosure

The present disclosure relates to a method for manufacturing a cast iron casting, and more particularly, to a suspension part of a suspension system for a vehicle, which is made from a cast iron casting having locally improved workability only in a region where machining is required.

Description of Related Art

Generally, a knuckle that is a main component constituting a suspension system in a vehicle should have necessary physical properties including excellent mechanical properties and excellent workability due to its characteristics that an arm (for example, a control arm or lower/upper arms) and a stabilizer bar are connected to the knuckle in a state in which the knuckle is mounted to a wheel. An example which satisfies the properties required for the knuckle includes a cast iron.

The contents described in Description of Related Art are to help the understanding of the background of the present disclosure, and may include what is not previously known to those skilled in the art to which the present disclosure pertains.

SUMMARY OF THE DISCLOSURE

One aspect of the invention provides a method for manufacturing a cast iron casting with fining graphite, which transforms a cast iron casting into an austempered ductile cast iron (ADI) whose strength and toughness are lowered due to the effect obtained by applying inoculant at least twice to a molten metal when manufacturing the cast iron casting, thereby providing excellent workability, and which can suppress an increase of manufacturing cost caused by using inoculant due to a local workability enhancing structure limited to a site requiring a machining to promote product competitiveness. In addition, another aspect of the present disclosure provides a suspension part made from the cast iron casting manufactured by the above method.

Still another aspect of the invention provides a method for manufacturing a cast iron casting with fining graphite may include comprising an inoculating process in which inoculation for adding inoculant to raw molten metal of raw material is divided into a primary inoculation and a secondary inoculation and is performed twice before the raw molten metal is solidified.

In one embodiment, the raw material may be scrap iron, pig iron, ferro alloy, and the like by which alloy component may be adjusted.

In one embodiment, the primary inoculation of the inoculant may be performed in a furnace in which the raw molten metal is contained, and the secondary inoculation may be performed in a mold into which the raw molten metal is injected. Component of the inoculant employed in the primary inoculation differs from component of the inoculant employed in the secondary inoculation.

In one embodiment, the inoculating process may include a melting process and an injecting process; the melting process may perform spheroidization in which spheroidizing agent is injected into the raw molten metal, together with the primary inoculation in which the inoculant is injected into the raw molten metal before the solidification, to transform the raw molten metal into inoculated molten metal in the furnace; and the injecting process may inject the inoculated molten metal after performing the secondary inoculation for injecting the inoculant into the mold, and then solidifies the inoculated molten metal in the mold to transform the inoculated molten metal into the cast iron casting.

In one embodiment, the primary inoculation may use ferrum-silicon (Fe-Si) as the inoculant, and Fe-Si may comprise Si of 0.3 wt % to 0.7 wt % with respect to whole components of the raw molten metal and remainder of Fe.

In one embodiment, the spheroidizing agent may comprises Fe or Fe-Mg ferro alloy.

In one embodiment, the secondary inoculation may use ferrum-silicon-bismuth (Fe-Si-Bi) as the inoculant, and Fe-Si-Bi may comprise Si of 0.3 wt % to 0.7 wt %, and Bi of 0.2 wt % to 0.5 wt % with respect to whole components of the inoculated molten metal, and remainder of Fe.

In one embodiment, the secondary inoculation may be performed on a machined portion on the cast iron casting, and the machined portion may be formed on a part of entire region of the cast iron casting.

In one embodiment, the necessity of adjusting component of the raw molten metal may be confirmed before injecting the inoculant or injecting the spheroidizing agent.

In one embodiment, the cast iron casting may be taken out from the mold when completely solidified in the mold and may be then subjected to a heat treatment to be transformed into austempered ductile cast iron (ADI).

In one embodiment, the heat treatment may be an austempering heat treatment.

In one embodiment, the austempered ductile cast iron may be machined to be made into a knuckle of a suspension system.

A further aspect of the invention provides a suspension part that may include a knuckle formed by primarily inoculating molten metal using Fe-Si as inoculant and spheroidizing the molten metal using Fe or Fe-Mg ferro alloy as spheroidizing agent, secondarily inoculating the molten metal using Fe-Si-Bi as inoculant and austempering-heat treating the molten metal in a solidified state to transform the molten metal into austempered ductile cast iron, and machining a machined portion, which has providing fine graphite through the secondary inoculation, of whole region of the austempered ductile cast iron.

In one embodiment, in the austempered ductile cast iron, the machined portion may have an average size of spheroidal graphite of 30 μm or less and the number of graphite particles per unit area (1 $mm^2$) of 310 to 450, and a non-machined portion other than the machined portion may have an average size of spheroidal graphite of 40 to 50 μm and the number of graphite particles per unit area (1 $mm^2$) of 320 to 350.

In one embodiment, a spheroidizing ratio of the machined portion may be 65% to 75%, and a spheroidizing ratio of the non-machined portion may be 61% to 64%.

DESCRIPTION OF EMBODIMENTS

Hereinafter, a method for manufacturing austempered ductile cast iron with improved workability and a product of the austempered ductile cast iron (ADI) manufactured thereby will be described.

Meanwhile, the terms of "comprises" or "adds" as used herein should not be construed as necessarily encompassing the various elements or steps described in the specification, and should be construed as that some of these elements or step may not be included and as that additional elements or steps may be further included.

In addition, in the method for manufacturing the austempered ductile cast iron (ADI) of the present disclosure, the term of "inoculation" means a process in which, in order to form a graphite shape and microstructure, an inoculant is added to molten metal of raw material to homogenize a matrix.

In an implementation, a material which satisfies the properties required for the knuckle includes austempered ductile cast iron (ADI) among various kinds of cast iron.

The ADI is the structure obtained by manufacturing a cast iron casting using ferrum casting ductile (FCD), and then improving a matrix inside the cast iron casting through a heat treatment (for example, austempering) to reinforce property of the FCD with an austempering.

Therefore, the ADI has a mixed structure of ferrite and pearlite as a matrix, so that the ADI can overcome drawbacks of the FCD, which has lower strength and abrasion resistance than steel materials such as carbon steel, alloy steel and forged steel, through a matrix of bainite obtained by the austempering. As a result, the ADI can have excellent mechanical properties in ductility, toughness, fatigue strength and abrasion resistance as well as high strength compared to the FCD.

Thus, the ADI can be used as a material suitable for the knuckle which should satisfy excellent workability together with excellent mechanical properties.

However, required workability of the knuckle cannot be satisfied with the ADI because high strength and toughness of the bainite matrix of the ADI result in poor workability.

For this reason, attempts may be made to develop various technologies to improve poor workability of the ADI. In some implementations, expensive elements may be used; however, the use of expensive elements may increase cost.

Figure 1:
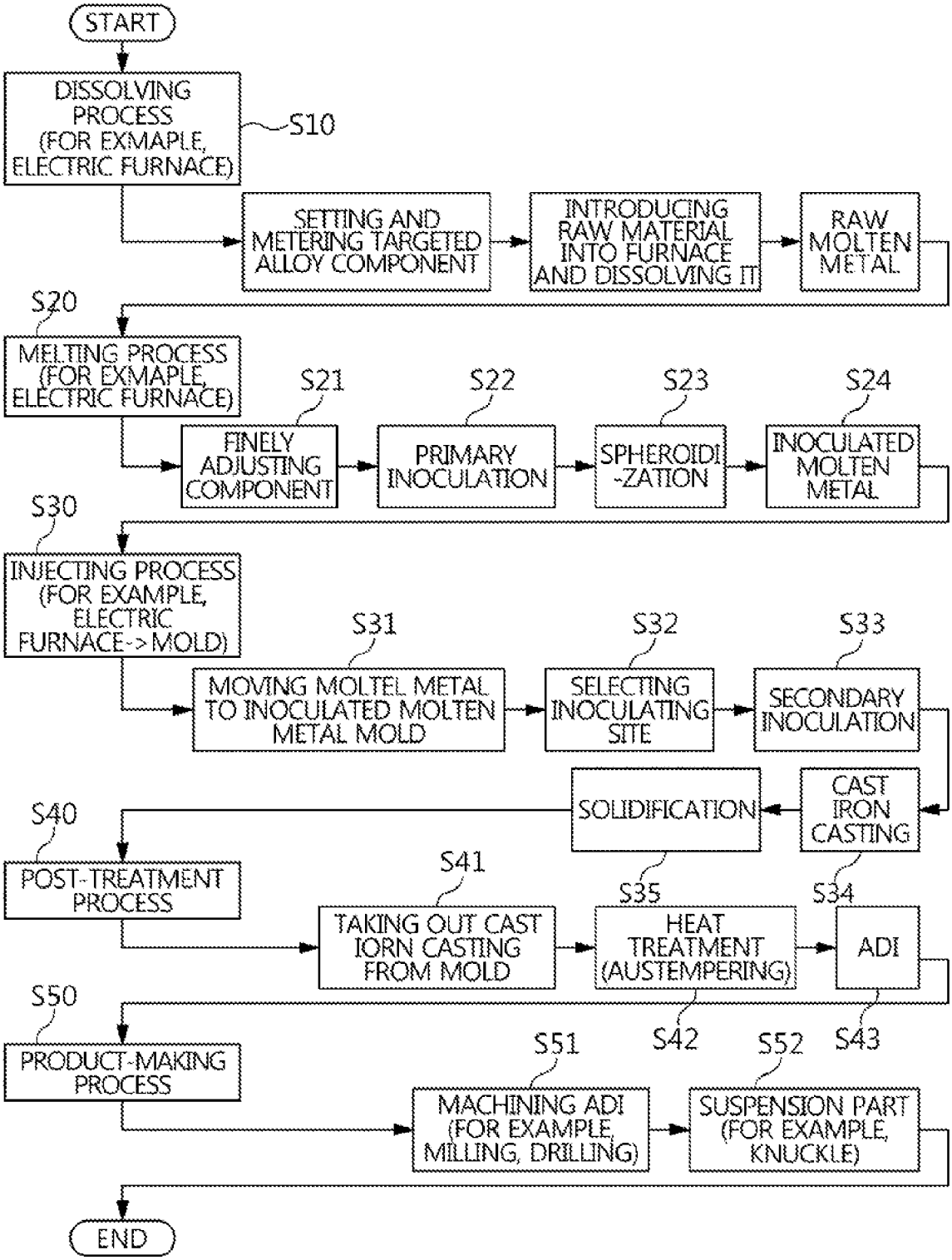
FIG. 1 is a schematic view briefly illustrating a method for manufacturing a cast iron casting with fining graphite according to the present disclosure to which a suspension part is applied.
Figure 2:
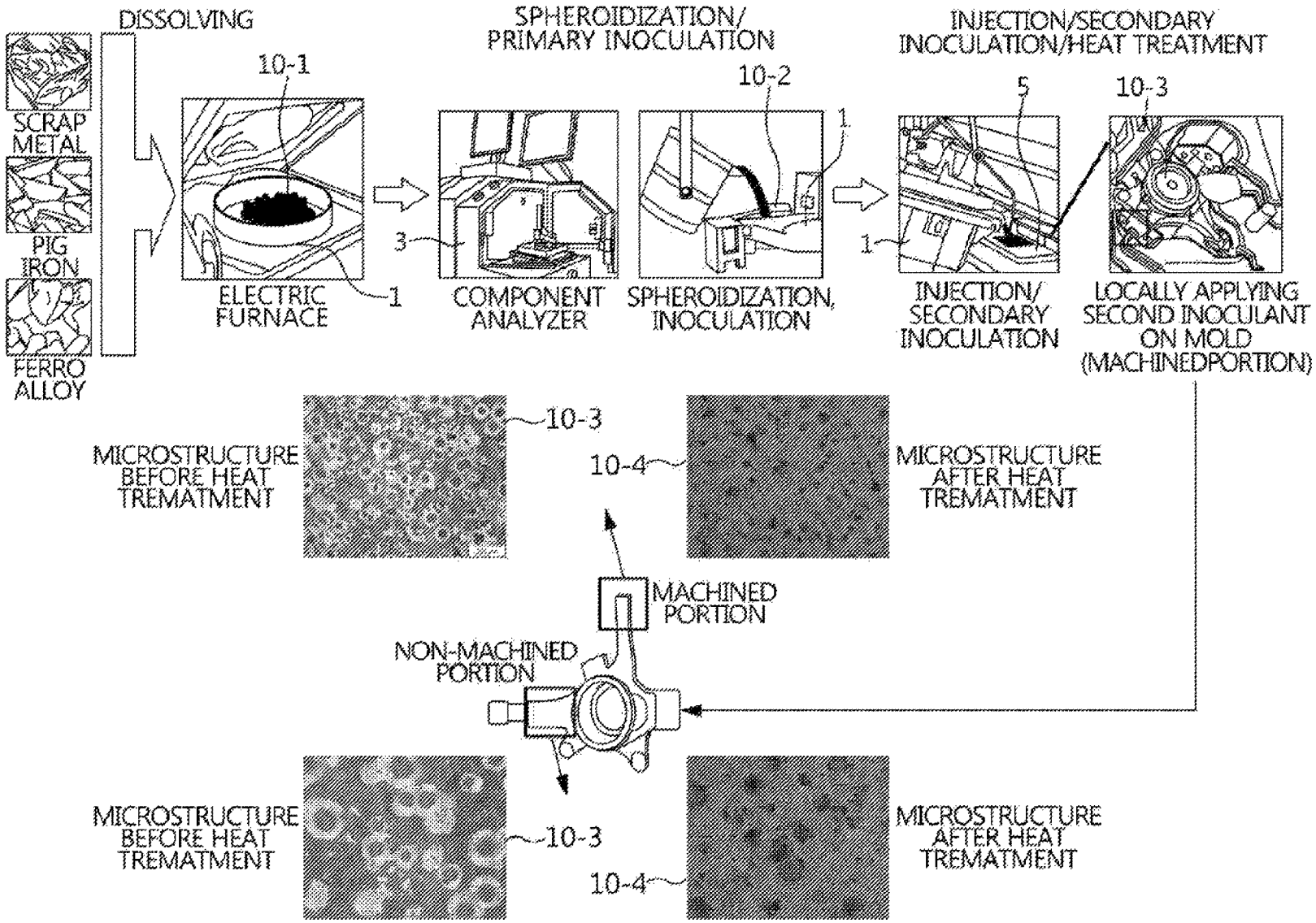
FIG. 2 is a view showing a state in which the cast iron casting with fining graphite of the present disclosure is transformed into austempered ductile cast iron (ADI) having improved workability by lowering strength and toughness.

Referring to FIG. 1, in one embodiment, the method for manufacturing a cast iron casting with fining graphite is implemented by a dissolving process of S10, a melting process of S20, an injecting process of S30, a post-treatment process of S40, and a product-making process of S50. Specifically, the above dissolving/melting/injecting/post-treatment processes of S10 to S40 are described with reference to FIG. 2.

Particularly, the melting process S20 and the injecting process S30 are specialized as an inoculation process, and inoculant added into molten metal of raw material is divided into primary and secondary inoculants before solidification of the molten metal, inoculation is performed twice.

As one example, in the dissolving process S10, the raw material is metered according to targeted alloy component, and is then dissolved in a furnace 1 (for example, electric furnace or a blast furnace). To this end, in the dissolving process S10, the alloy component of the raw material is adjusted by scrap metal, pig metal, ferro alloy and the like as a targeted alloy component setting and metering step of S11, and the metered raw material is introduced into and dissolved in the furnace 1 as an introducing and dissolving step of S12. As a result, in the dissolving process S10, raw molten metal 10-1 in S13 is secured (S13).

As one example, in the melting process S20, micro component adjustment is performed through a component analyzer, and inoculation and spheroidizing treatment, and the like are performed to adjust the shape of graphite. In this case, the above inoculation is named as a primary inoculation so as to distinguish this inoculation from inoculation in the injecting process S30.

To this end, in the melting process, the component of the raw molten metal 10-1 is finely adjusted through a component analyzer 3 as in a fine component adjusting step S21, and the raw molten metal 10-1 contained in the furnace 1 is inoculated with the inoculant, as in a primary inoculation step of S22. As in a spheroidizing step of S23, the spheroidizing agent is added into the raw molten metal 10-1 contained the furnace 1 so as to adjust the shape of graphite to a spherical shape. In this case, the primary inoculation step S22 and the spheroidizing step S23 may be implemented by injecting the spheroidizing agent after injecting the inoculant or by injecting the inoculant after injecting the spheroidizing agent or As a result, inoculated molten metal 10-2 having spheroidal graphite, which is entirely homogenized by a graphite spheroidization performed in the raw molten material 10-1, is secured in the above-described melting process S20.

In this case, the component analyzer 3 measures a component in the molten metal using equipment capable of specially regulating the content ratio of the component of the raw material.

In particular, it is preferable to employ ferrum (Fe) or a ferrum-magnesium (Fe-Mg) ferro alloy as the spheroidizing agent, and in the case of the spheroidizing agent of the Fe-Mg ferro ally, it is preferable that Mg of 0.015 wt % or more with respect of whole weight of the raw material molten metal 10-1 is added and remainder is Fe. Here, the content of Mg is not particularly limited to the above. The primary inoculant is preferably composed of ferrum-silicon (Fe-Si), and the amount of the primary inoculant is not particularly limited. However, it is preferable that Si of 0.3 wt % to 0.4 wt % with respect of whole components of the raw material molten metal 10-1 is included and remainder is Fe. In this case, the content of Si is regulated to be 2.0 wt % to 3.0 wt % with respect to an entire casting product.

As one example, in the injection process S30, the mold 5 according to a movement of the furnace 1 is prepared and inoculation is performed in the mold 5 before the inoculating molten metal 10-2 is injected. In this case, this inoculation is named as a secondary inoculation so as to distinguish this inoculation from the inoculation performed in the melting process S20. Particularly, the secondary inoculation is performed in part to be fitted to a product shape of a mold 5 (for example, a knuckle 10 shown in FIG. 3). Here, a portion fitted to the product shape is a machined portion on which a mechanical machining process such as a milling, a drilling and a reaming is performed, and a portion, that is not subjected to a machining process, except for the machined portion is a non-machined portion and is distinguished from the machined portion.

To this end, in the injecting process S30 the mold 5 into which the inoculated molten metal 10-2 of the furnace 1 is injected is provided as in a step S31 of moving the molten metal to an inoculated molten metal mold, and the machined portion requiring the secondary inoculation is selected as in an inoculating site selection step of S32, and a secondary inoculation selecting portion of the mold 5 is inoculated with the inoculant as in a secondary inoculation step of S33. Finally, the inoculated molten metal 10-2 is injected into the mold 5 and is then cooled as in a solidifying step of S34.

As a result, cast iron casting 10-3 that is cooled to a room temperature is secured in the injecting process step S30. In this case, the cast iron casting 10-3 is ferrum casting ductile (FCD), and in particular, secondary inoculant is dissolved in the raw molten metal at the machined portion which is a site on which the secondary inoculant is applied, so that the cast iron casting is made into a cast iron casting with fining graphite by micronizing spheroidal graphite of a local structure. As one example, the graphite in the machined portion of the cast iron casting 10-3 has a size of 30 μm or less, whereas the graphite in the non-machined portion has a size of 60 μm or less, and assuming that workability of the non-machined portion is 100% (criterion), workability of the machined portion is improved to 120%. In this case, the workability of 100% means a reference value for easiness of machining of metal material using a machine tool, which usually indicates a cutting depth per unit time (cm/minute).

In particular, the secondary inoculant is inoculant capable of performing micronization of spheroidal graphite in a matrix so as to improve mechanical workability.

It is preferable that the secondary inoculant comprise Fe-Si-Bi. In the secondary inoculant composed of Fe-Si-Bi, it is preferable that, with respect to whole components of the inoculated molten metal 10-2, Si of 0.3 wt % to 0.7 wt % is contained, bismuth (Bi) of 0.2 wt % to 0.5 wt % is contained, and remainder is Fe. In one embodiment, in the secondary inoculant composed of Fe-Si-Bi, it is preferable that Si of 0.4 wt % with respect to whole components of the inoculated molten metal 10-2 is included, Bi of 0.4 wt % with respect to whole components of the inoculated molten metal 10-2 is included, and remainder is Fe. In this case, the content of Si is regulated to be 2.0 wt % to 3.0 wt % with respect to the entire casting product.

As one example, in the post-treatment process S40, the cast iron casting 10-3 taken out of the mold 5 is transformed into an austempered ductile cast iron 10-4 through an austempering heat treatment.

To this end, in the post-treatment process S40, the cooled cast iron cast 10-3 is taken out from the mold 5 as in a mold-extracting step of S41, and is subjected to the austempering heat treatment as in a heat treatment step of S42. As a result, the austempered ductile cast iron 10-4 is secured in the post-treatment process S40. In this case, workability of the non-machined portion of the austempered ductile cast iron 10-4 is improved by 20% due to the heat treatment effect, whereas workability of the machined portion is improved by 70% by the effect of the heat treatment.

In particular, as one embodiment, in the austempering heat treatment method for manufacturing the austempered ductile cast iron 10-4, the cast iron casting 10-3, that is the ferrum casting ductile, is heat-treated to a prescribed temperature to be austenitized, and is then cooled to be bainitized, and is maintained in an isothermal state to stably form a bainite structure on a surface of material, whereby the austempered ductile cast iron can be manufactured. At this time, the heat treatment may be performed at a temperature ranging from 890° C. to 930° C. for 1 to 10 minutes.

The above-mentioned austempering heat treatment method is not limited to only the above-described method, and can be applied as various methods for manufacturing the austempered ductile cast iron 10-4 by changing the temperature and time range conditions.

Figure 3:
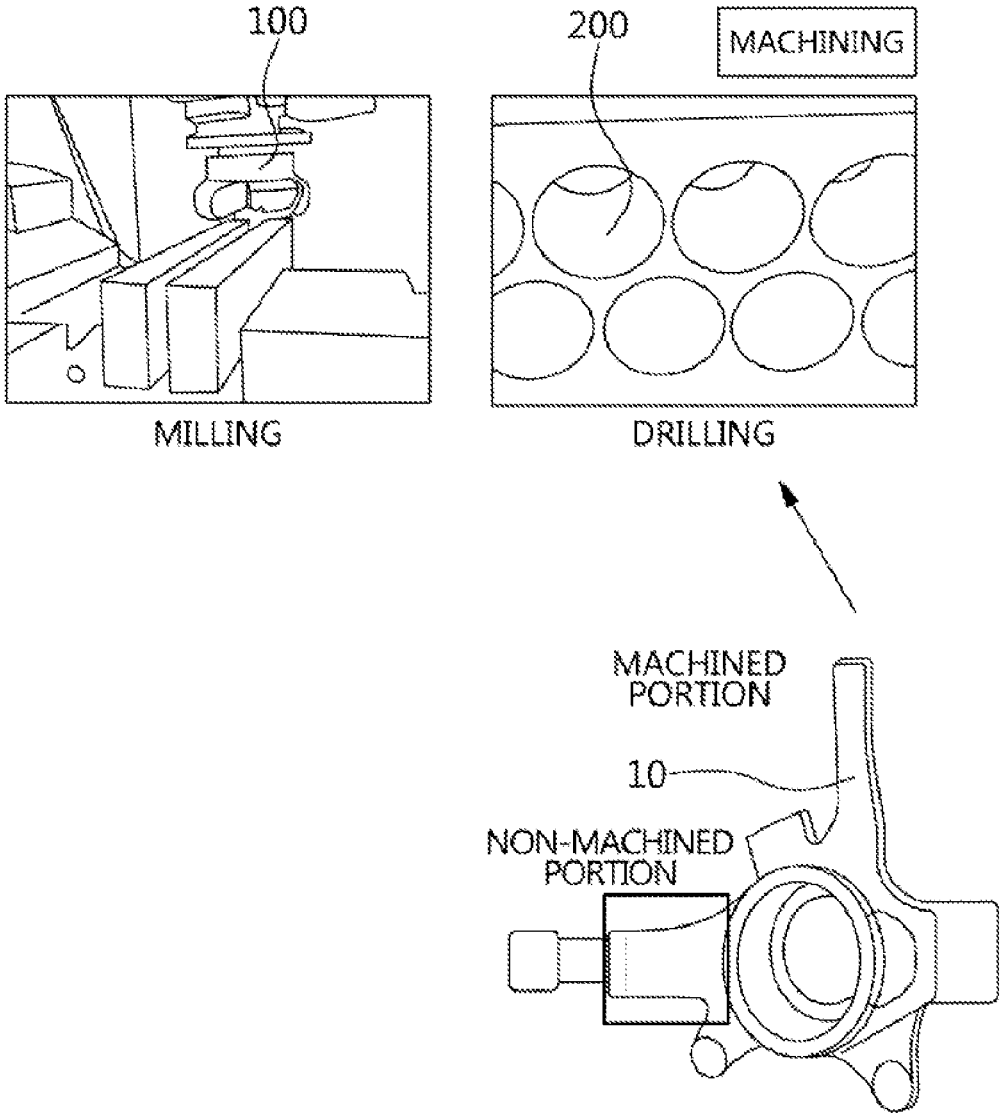
FIG. 3 is a view a state in which the ADI of the present disclosure is being processed to be manufactured as a knuckle of a suspension part.

Specifically, the product-making process of S50 is described with reference to FIG. 3 as follows.

As one example, in the product-making process S50, a product is prepared using the austempered ductile cast iron 10-4. In the product-making process S50, to this end, a milling, drilling or reaming process is employed for machining a necessary surface/hole/tap according to a designed shape as in a step of S51 of machining the austempered ductile cast iron, whereby a suspension part is secured at a step S52.

In this case, as the above suspension part, the knuckle 10 is manufactured.

Hereinafter, the present disclosure is described in detail with reference to examples and comparative examples. These examples and comparative examples are only illustrative and can be implemented in the various different forms by one skilled in the art to which the present disclosure pertains, so that the present disclosure is not necessarily limited to these examples described herein. In the below description, in addition, the furnace 1 includes an electric furnace and a blast furnace, but is described as the blast furnace, the raw molten metal 10-1 and the inoculated molten metal 10-2 are referred to as a single term of the raw molten metal, and the cast iron casting 10-3 and the austempered ductile cast iron 10-4 are referred to as a single of the ferrum casting ductile. In addition, an indication of the content of wt % for each of Fe-Si and Fe-Si-Bi indicates Si and Bi as wt % with respect to whole components of the molten metal, which are regarded as 100%, and remainder of Fe.

In Example, 1, the spheroidizing agent composed of Mg of 0.015 wt % or more and remainder of a Fe-Mg ferro alloy of Fe, and the primary inoculant composed of Fe-Si were added to the raw molten metal melted in the blast furnace to manufacture the graphite-spheroidized raw molten metal, and the raw molten metal prepared as above was injected into the mold in which Fe-Si-Bi composed of Fe-Si of 0.4 wt % and Bi of 0.1 wt % was locally applied as the secondary inoculant only to the machined portion. Then, the austempering heat treatment was performed for the produce made from the prepared ferrum casting ductile.

Example 2 was carried out in the same manner as in Example 1, except that Fe-Si-Bi composed of Fe-Si of 0.4 wt % and Bi of 0.2 wt % was employed as the secondary inoculant.

Example 3 was carried out in the same manner as in Example 1, except that Fe-Si-Bi composed of Fe-Si of 0.4 wt % and Bi of 0.4 wt % was employed as the secondary inoculant.

Example 4 was carried out in the same manner as in Example 1, except that Fe-Si-Bi composed of Fe-Si of 0.4 wt % and Bi of 0.5 wt % was employed as the secondary inoculant.

In Comparative Example, 1, the spheroidizing agent composed of Mg of 0.015 wt % or more and remainder of a Fe-Mg ferro alloy of Fe was added to the raw molten metal melted in the blast furnace, the raw molten metal was primarily inoculated with the inoculant composed of Fe-Si to perform a spheroidization, and was secondarily inoculated with the inoculant composed of Fe-Si again to prepare the raw molten metal and inject it into the mold. Then, the austempering heat treatment was performed for the produce made from the prepared ferrum casting ductile.

Comparative Example 2 was carried out in the same manner as in Comparative Example 1, except that Fe-Si-Bi composed of Fe-Si of 0.4 wt % and Bi of 0.4 wt % was employed as the secondary inoculant.

Comparative Example 3 was carried out in the same manner as in Comparative Example 1, except that Fe-Si of 0.4 wt % was applied as the secondary inoculant on the mold.

Physical properties for a spheroidizing ratio, an average size of graphite, a surface area of graphite, the number of graphite particle of each of test specimens, which were taken from a point at a distance of 10 mm from surfaces of the machined portions and the non-machined portions of the austempered ductile cast irons prepared in Examples 1 to 3 and Comparative Example 1 to 3, were evaluated and, the measurement results are shown in Tables 1 and 2 below.

In this case, the spheroidizing ratio (%), the average size (μm) of graphite, and the number of graphite particle (the number/mm$^2$) may be measured by various methods, but a value of the spheroidizing ratio obtained by KS D 4302: 2011, and a value of the average size of graphite obtained by ISO 945-1:2008, and a value of the number of graphite particle obtained by ISO 945-1:2008 were applied. In particular, as can be seen in Example 1 of Table 1 and Example 1 of Table 2, in which the content of bismuth (Bi) is out of the application range of the present disclosure, the difference in the graphite size is influenced by the difference in the content of bismuth (Bi).

TABLE 1

| | | | Matrix of machined portion (Point at a distance of 10 mm from a surface of machined portion) | | | |
|---|---|---|---|---|---|---|
| Classification | Inoculation method | Inoculant | Spheroidizing ratio (%) | Average size of graphite (μm) | Surface of graphite (%) | The number of graphite particle (/mm$^2$) |
| Comparative Example 1 | Molten metal | Fe—Si of 0.4 wt % | 68.0 | 59 | 7.7 | 256 |
| Comparative Example 2 | Molten metal | Fe—Si of 0.4 wt % + Bi of 0.4 wt % | 65.5 | 49 | 7.6 | 309 |
| Comparative Example 3 | Mold | Fe—Si of 0.4 wt % | 58.8 | 46 | 7.3 | 325 |
| Example 1 | Mold | Fe—Si of 0.4 wt % + Bi of 0.1 wt % | 64.7 | 39 | 7.0 | 317 |
| Example 2 | Mold | Fe-Si of 0.4 wt % + Bi of 0.2 wt % | 66.4 | 29 | 5.9 | 373 |
| Example 3 | Mold | Fe—Si 0.4 wt % + Bi 0.4 wt % | 73.1 | 26 | 5.8 | 443 |
| Example 4 | Mold | Fe-Si 0.4 wt % + Bi 0.5 wt % | 74.9 | 27 | 5.8 | 433 |

TABLE 2

| Classification | Secondary Inoculation method | Secondary Inoculant | Matrix of non-machined portion (Point at a distance of 10 mm from a surface) Spheroidizing ratio (%) | Average size of graphite (μm) | Surface of graphite (%) | The number of graphite particle (/mm$^2$) |
|---|---|---|---|---|---|---|
| Comparative Example 1 | Molten metal | Fe—Si of 0.4 wt % | 69.8 | 57 | 7.8 | 239 |
| Comparative Example 2 | Molten metal | Fe—Si of 0.4 wt % + Bi of 0.4 wt % | 62.7 | 50 | 7.4 | 315 |
| Comparative Example 3 | Mold | Fe—Si of 0.4 wt % | 70.2 | 59 | 7.7 | 242 |
| Example 1 | Mold | Fe—Si of 0.4 wt % + Bi of 0.1 wt % | 62.9 | 47 | 7.6 | 330 |
| Example 2 | Mold | Fe-Si of 0.4 wt % + Bi of 0.2 wt % | 61.3 | 47 | 7.4 | 329 |
| Example 3 | Mold | Fe—Si 0.4 wt % + Bi of 0.4 wt % | 62.5 | 48 | 7.7 | 336 |
| Example 4 | Mold | Fe-Si 0.4 wt % + Bi of 0.5 wt % | 63.1 | 46 | 7.5 | 346 |

TABLE 3

| | Amount of applied inoculant (g) | Depth (mm) by which micro structure was created ※Criterion of graphite size of 30 μm or less |
|---|---|---|
| A | 1 | 0 to 0.5 mm |
| B | 5 | 6 to 7 mm |
| C | 10 | 12 to 14 mm |
| D | 20 | 20 mm or more |
| E | 50 | 20 mm or more |

Applied inoculant: Fe—Si of 0.4 wt % + Bi of 0.4%,
Weight of mold casting: 5 kg each In particular, Table 3 illustratively represents effects that a depth by which microstructure is created is determined according to the amount of inoculant which is applied when the secondary inoculation is locally performed (however, it can be variably applied depending on a thickness of the part) and that when the inoculant of 20 g or more is applied, micro graphite is formed by the entire depth depending on the shape due to creation of microstructure of 20 mm or more.

Figure 4:
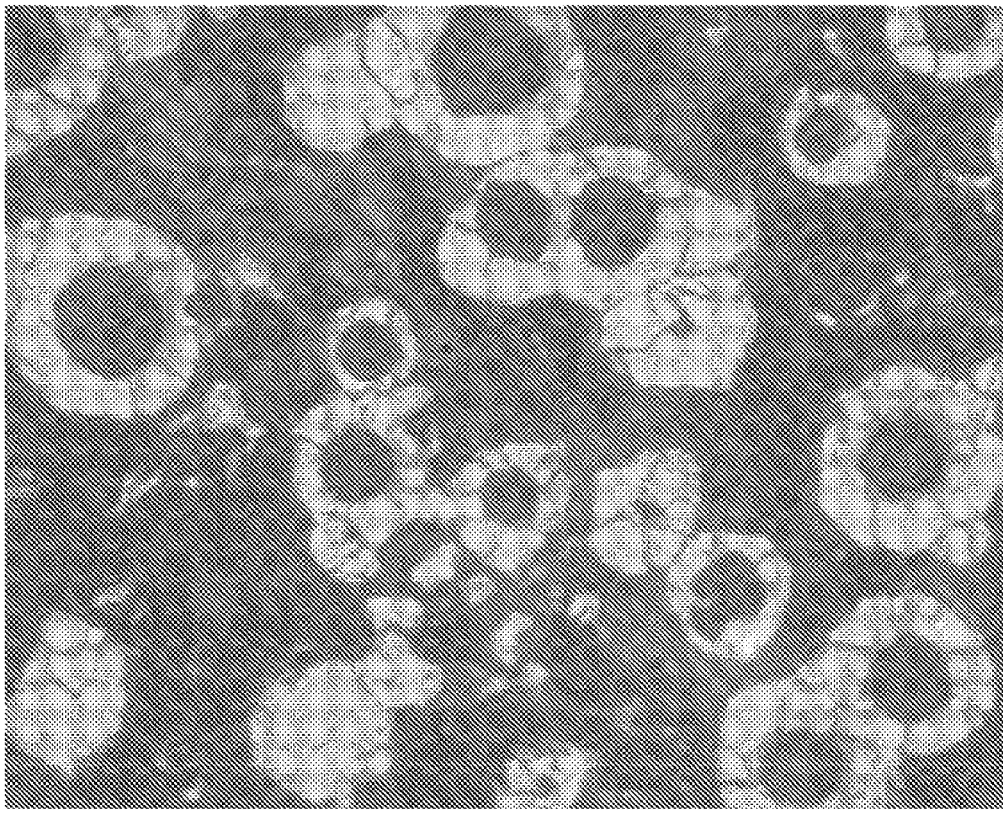
FIG. 4 is a photograph, taken by an optical microscope, of a matrix of ferrum casting ductile (FCD) in a non-machined portion according to the Example 1 of the present disclosure.
Figure 5:
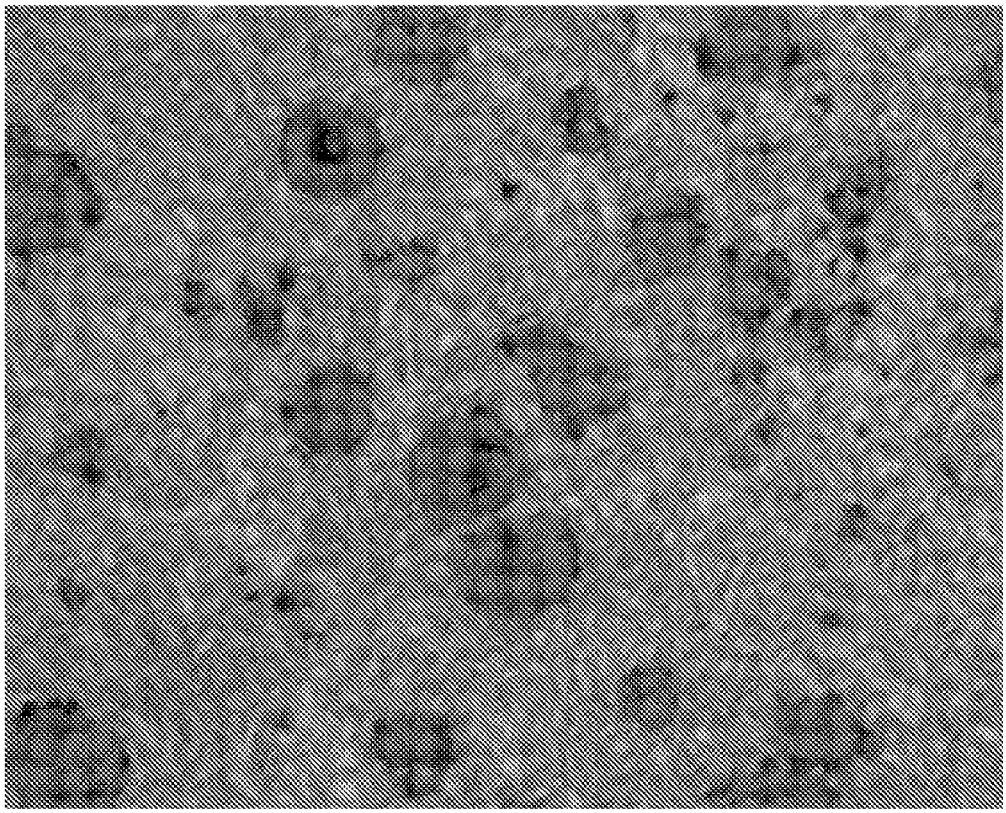
FIG. 5 is a photograph, taken by an optical microscope, of a matrix in a non-machined portion of the austempered ductile cast iron (ADI) formed through an austempering heat treatment according to Example 3 of the present disclosure.
Figure 6:
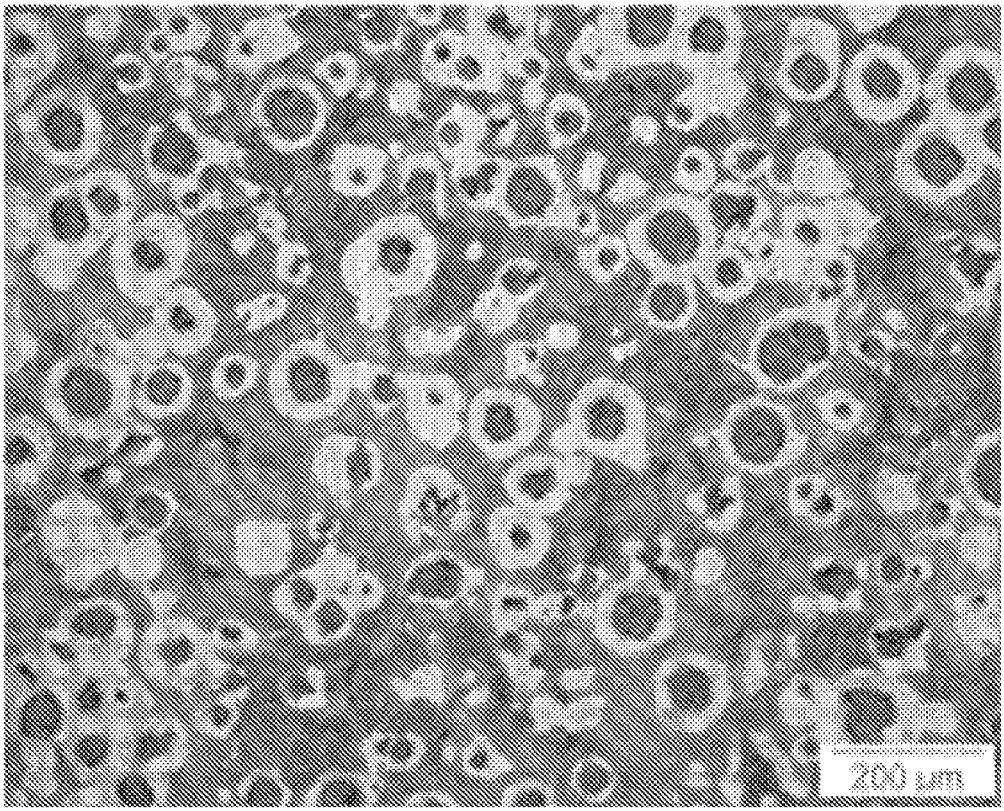
FIG. 6 is a photograph, taken by an optical microscope, of a matrix in a machined portion of the ferrum casting ductile (FCD) according to Example 3 of the present disclosure.

Further, the matrixes of the ferrum casting ductile (FCD) or ductile cast iron manufactured by respective manufacturing methods in Example 3 and Comparative Example 3 and the matrix of the austempered ductile cast iron (ADI) manufactured by austempering heat-treating the ferrum casting ductile were confirmed with an optical microscope, the results thereof are shown in FIGS. 4 to 6.

FIG. 4 is a photograph, taken by an optical micrograph, of the matrix of the non-machined portion of the ferrum casting ductile (FCD) manufactured in Example 3 of the present disclosure.

In the matrix, the matrix is composed of mixed structure of ferrite and pearlite, and the graphite size is 40 to 60 μm, and a tensile strength is about 500 MPa. In this case, the tensile strength of 500 MPa illustratively shows the measurement value measured by KS B 0802:2003.

FIG. 5 is a photograph, taken by an optical microscope, of the matrix of the non-machined portion of the austempered ductile cast iron formed by the austempering heat treatment in Example 3 of the present disclosure. From this matrix, it could be confirmed that the graphite size was 40 to 60 μm, which is the same as that before performing the heat treatment, but the matrix was transformed into bainite, so that the austempered ductile cast iron having a high tensile strength of approximately 1000 MPa was formed.

FIG. 6 is a photograph, taken by an optical microscope, of the matrix of the machined portion of the ferrum casting ductile manufactured in Example 3 of the present disclosure. From this matrix, it could be confirmed that micro graphite having the spheroidizing ratio of 70% and the graphite size of 30 μm or less was formed.

Figure 7:
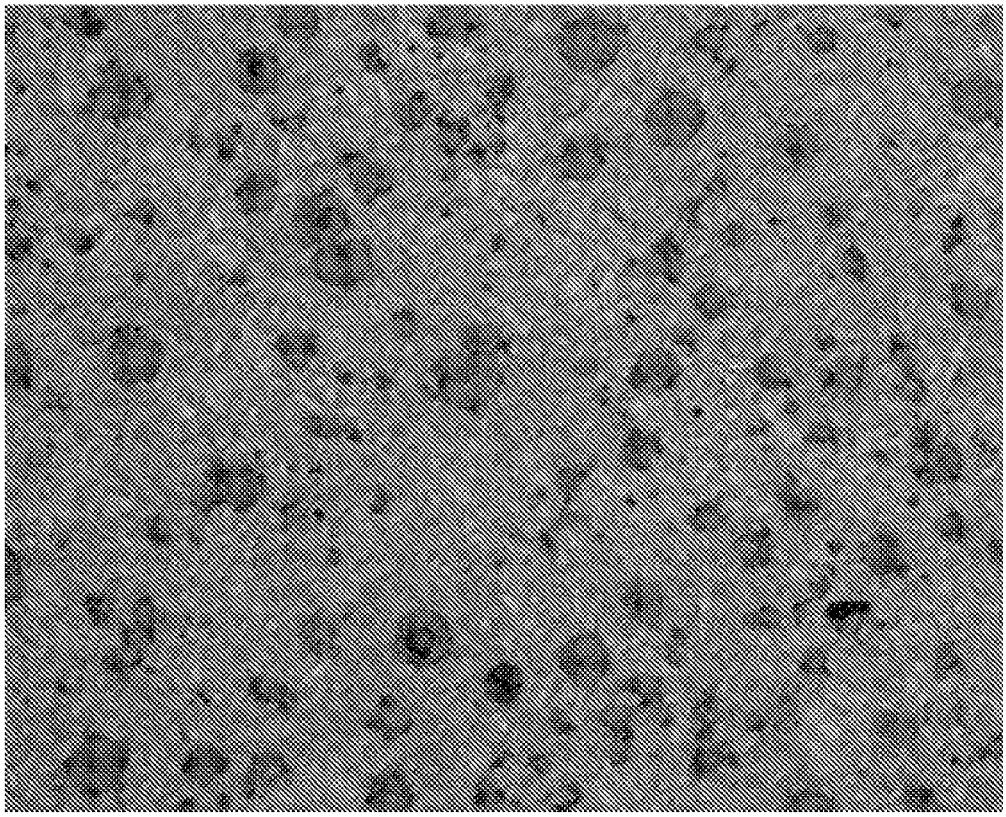
FIG. 7 is a photograph, taken by an optical microscope, of a matrix in a machined portion of the austempered ductile cast iron (ADI) formed through the austempering heat treatment according to Example 3 of the present disclosure.

FIG. 7 is a photograph, taken by an optical microscope, of the matrix of the machined portion of the austempered ductile cast iron formed through the austempering heat treatment in Example 3 of the present disclosure. From this photograph, it was confirmed that the graphite size is 30 μm or less and was equal to that before the heat treatment.

Figure 8:
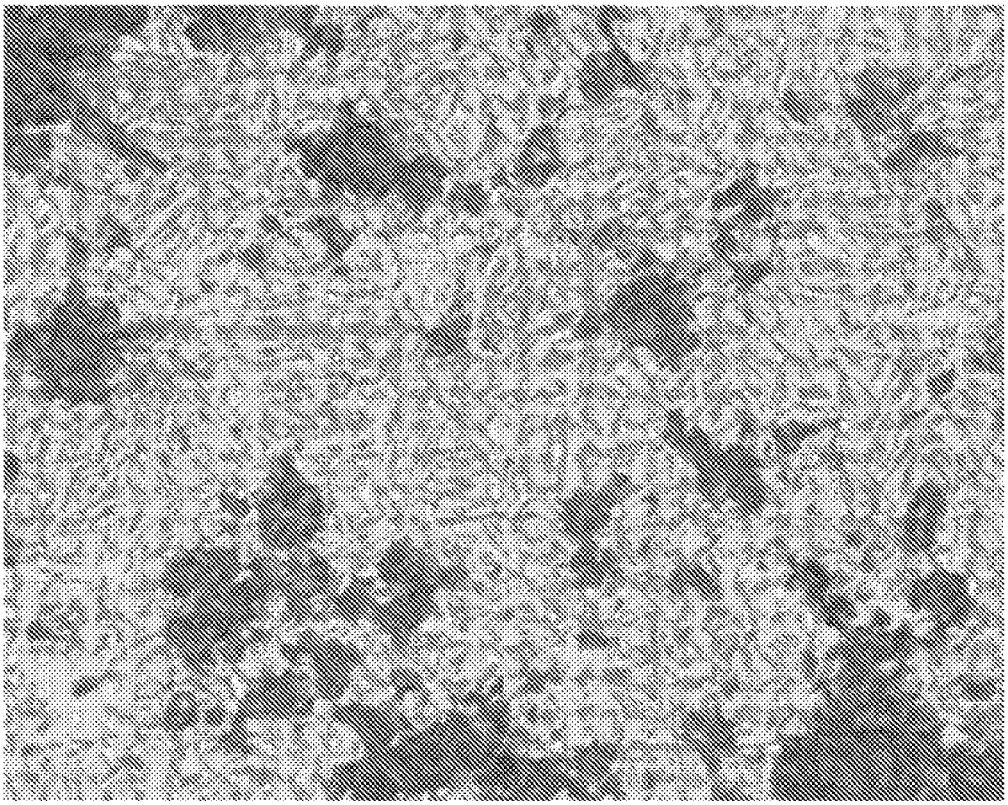
FIG. 8 is a photograph, taken by an optical microscope, of the matrix in the machined portion of the austempered ductile cast iron, when only a secondary inoculation is performed to a mold in the method for manufacturing the austempered ductile cast iron of the present disclosure.

FIG. 8 is a photograph, taken by an optical microscope, of the matrix of the austempered ductile cast iron formed by injecting the manufactured raw molten metal into the mold which is coated with the secondary inoculant composed of Fe-Si of 0.4 wt % and Bi of 0.4 wt %, without adding the primary inoculant composed of Fe-Si in the raw molten metal melted in the furnace, and performing the austempering heat treatment in the method for manufacturing the austempered ductile cast iron of the present disclosure.

As shown in FIG. 8, it could be confirmed that, when the mold was inoculated with only the secondary inoculant without inoculating the primary inoculant, creation of graphite in the raw molten metal was poor and creation of spheroidal graphite in a deep part was not properly achieved.

From the above results, it could be confirmed that only if both the primary inoculation in the molten metal and the secondary inoculation in the mold were carried out, the austempered ductile cast iron having the matrix stably formed therein and having improved workability could be manufactured.

Figure 9:
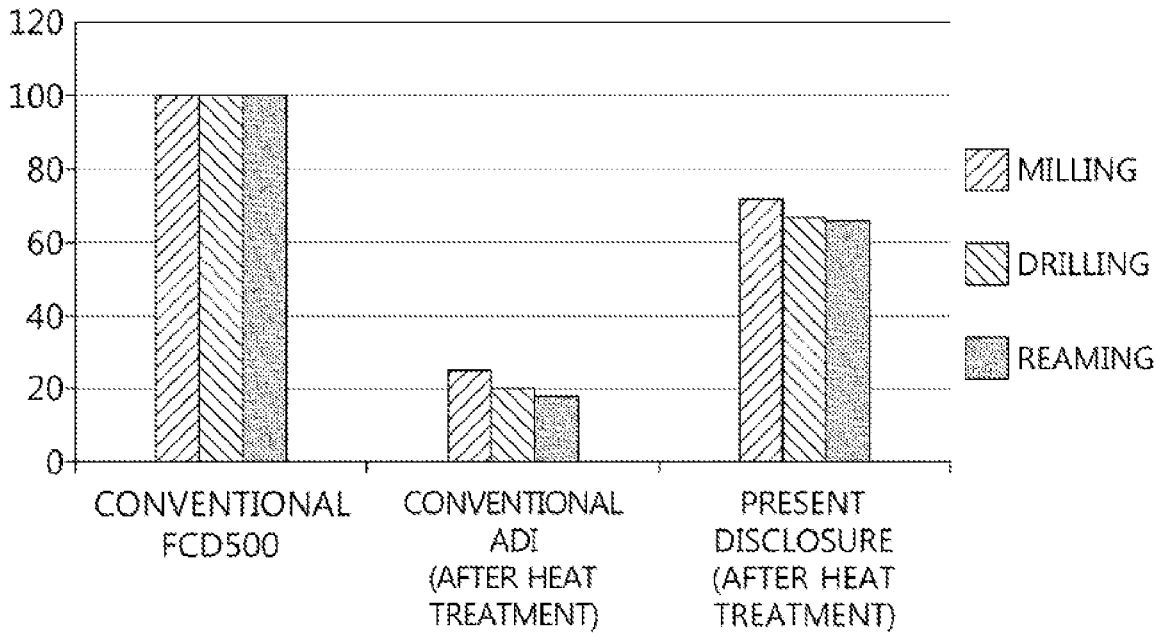
FIG. 9 is a graph showing the results of measurement of mechanical workability in a machined portion of a product including the austempered ductile cast iron manufactured according to Example 3 of the present disclosure.

FIG. 9 is a graph showing the results of measurement of mechanical workability in the machined portion of the austempered ductile cast iron product manufactured according to Embodiment 3 of the present disclosure. Based of workability, which was regarded as 100%, of milling, drilling and reaming on the ferrum casting ductile before the austempering heat treatment, at this time, the workability was evaluated.

As shown in FIG. 9, in the case of conventional austempered ductile cast iron after performing the austempering heat treatment, when workability machinability of ferrum casting ductile before performing the austempering heat treatment was regarded as criterion of 100%, workability in all of machining processes was approximately 20%, so that the workability was not significantly enhanced. However, the austempered ductile cast iron of the present disclosure after performing the austempering heat treatment represented the workability of 60% or more in the all processes of milling, drilling and reaming, so that it could be confirmed that the workability was improved.

According to the method for manufacturing the fining graphite cast iron casting according to the present disclosure as described above, since the austempered ductile cast iron having lowered strength and toughness due to fining graphite caused by injecting the different inoculants is made from a cast iron casting, there is the advantage that the austempered ductile cast iron has excellent workability required by the knuckle of suspension system and improves product competitiveness due to low cost.

Further, according to the method for manufacturing the austempered ductile cast iron of the present disclosure, micro graphite of 30 μm or less is locally formed on the machined portion by the secondary inoculant applied on the machined portion of the mold, workability of the machined portion is improved to 120% with respect to workability of 100% of the ferrum casting ductile in which micro graphite is not formed. In addition, when the austempered ductile cast iron is formed through the heat treatment called "austempering", workability of the machined portion is maintained at about 70%. Therefore, there is the effect that, compared with workability of about 20% of the conventional austempered ductile cast iron, workability is extraordinarily improved.

In addition, since the method for manufacturing the austempered ductile cast iron of the present disclosure does not use expensive metal such as nickel (Ni) as the secondary inoculant, but uses bismuth (Bi), when products are mass produced, there is a possibility that the manufacturing cost may be lowered.

Although the present disclosure has been described with a focus on novel features of the present disclosure applied to various embodiments, it will be apparent to those skilled in the art that various deletions, substitutions, and changes in the form and details of the apparatus and method described above may be made without departing from the scope of the present disclosure. Accordingly, the scope of the present disclosure is defined by the appended claims rather than by the foregoing description. All modifications within the equivalent scope of the appended claims are embraced within the scope of the present disclosure.

What is claimed is:

1. A suspension part including a knuckle formed by primarily inoculating molten metal using Fe-Si as a primary inoculant and spheroidizing the molten metal using Fe or Fe-Mg ferro alloy as spheroidizing agent, secondarily inoculating the molten metal using Fe-Si-Bi as secondary inoculant and austempering-heat treating the molten metal in a solidified state to transform the molten metal into austempered ductile cast iron (ADI), and machining a machined portion, which has fining graphite through the secondary inoculation;

wherein the secondary inoculant comprises Fe-Si-Bi, with a concentration of 0.3 wt % to 0.7 wt % Si and 0.2 wt % to 0.5 wt % Bi with respect to whole components of the molten metal, and the remainder Fe; and wherein the ADI product further comprises a non-machining portion that is not subject to machining, the machining portion having an average size of spheroidal graphite of 30 μm or less and the number of graphite particles per unit area of 1 $mm^2$ of 310 to 450, and the non-machining portion having an average size of spheroidal graphite of 40 to 50 μm and the number of graphite particles per unit area of 1 $mm^2$ of 320 to 350.

2. The suspension part of claim 1, wherein a spheroidizing ratio of the machined portion is 65% to 75%.

3. The suspension part of claim 1, wherein a spheroidizing ratio of the non-machined portion is 61% to 64%.

* * * * *